US006923597B2

(12) United States Patent
Burger

(10) Patent No.: US 6,923,597 B2
(45) Date of Patent: Aug. 2, 2005

(54) TAIL SHIELD FOR A SHIELD TUNNELING APPARATUS

(75) Inventor: Werner Burger, Schwanau (DE)

(73) Assignee: Herrenknecht AG, Schwanau (DE)

( * ) Notice: Subject to any disclaimer, the term of this patent is extended or adjusted under 35 U.S.C. 154(b) by 30 days.

(21) Appl. No.: 10/640,441

(22) Filed: Aug. 13, 2003

(65) Prior Publication Data

US 2004/0047692 A1 Mar. 11, 2004

(30) Foreign Application Priority Data

Aug. 14, 2002 (EP) ..... 02018328

(51) Int. Cl.[7] ..... E21D 11/10

(52) U.S. Cl. ..... 405/146; 405/150.2; 405/267; 405/268; 405/269

(58) Field of Search ..... 405/146, 150.1, 405/150.2, 266, 267, 268, 269

(56) References Cited

U.S. PATENT DOCUMENTS 5,536,151 A 7/1996 von Eckardstein

FOREIGN PATENT DOCUMENTS

| | | | |
|---|---|---|---|
| DE | 4136864 | | 11/1991 |
| DE | 4205144 | | 2/1992 |
| DE | 19800963 | | 7/1999 |
| JP | 2-128097 | * | 5/1990 |
| JP | 2-229397 | * | 9/1990 |

* cited by examiner

*Primary Examiner*—Sunil Singh
(74) *Attorney, Agent, or Firm*—Watts Hoffmann Co LPA

(57) ABSTRACT

Present in a tail shield (1) for a shield tunneling apparatus are a number of grouting lines (3) that are open to a tail shield end (4) and that can be supplied with filling material for grouting a ring gap (7) with the filling material, such as mortar, for example. In addition, additive material lines (8) that can be supplied with additive material are present, which empty into the grouting lines (3) in an end segment (12) of said grouting lines (3). As a result, an additive material, such as a solidification accelerator, for example, can be added immediately before the mixture is discharged into the ring gap (7), so that the risk of a blockage in the grouting lines (3), which are not accessible in the region of the tail shield end (4), is relatively low.

5 Claims, 6 Drawing Sheets

TAIL SHIELD FOR A SHIELD TUNNELING APPARATUS

TECHNICAL FIELD

The invention pertains to a tail shield for a shield tunneling apparatus.

BACKGROUND OF THE INVENTION

A tail shield having a number of grouting lines that are open to a tail shield end and that can be supplied with filling material for grouting a ring gap with the filling material is known from DE 41 36 864 C1. In the case of the previously known tail shield, grouting lines that are open to a tail shield end are present which are made from cast steel parts and are welded into a tail shield casing. The grouting lines can be supplied with mortar as the filling material for a ring gap. In addition, provided for cleaning the grouting lines are flushing openings, which can be closed off with covers and through which mortar that is present in the grouting lines can be removed during a break in the work before it solidifies and blocks the grouting lines. Disadvantageous about this device, along with the relatively cumbersome and labor-intensive cleaning, is the requirement that with a work break and the use of a relatively quick-solidifying filling material, the cleaning has to be started relatively quickly in order to avoid a closing off of the grouting lines.

From DE 198 00 963 A1, it is known that with a method for grouting a ring gap, additive material is mixed into a mortar as filling material for a ring gap in order to ensure quick initial shear strength, good flowability, and a restart of pumping at low pressure following a work break. While the holding times of the mixture of filling material and additive material in the grouting lines can be extended during work breaks, this approach is, however, relatively costly and is not always free of problems in terms of the chemicals that are often to be used in the groundwater area.

It is known from DE 42 05 144 A1 that with the pneumatic deployment of concrete that is hydromechanically conveyed inside the dense phase, to add to the dense phase pulverized additive material in the conveying air, such as, in particular, a solidification accelerator, before it emerges from a nozzle of an application device in the form of air-placed concrete. In the case of a hardening of concrete in the easily accessible application unit, due, for example, to a work break, the blocked parts are exchanged for new or newly cleaned ones.

The invention is based on the task of providing a tail shield of the type described above, with which, particularly in the case of the use of filling material mixed with additive materials that accelerate hardening, the risk of a grouting line becoming blocked is relatively low, even with relatively long work breaks.

SUMMARY OF THE INVENTION

With a tail shield of the type mentioned above, this task is carried out according to the invention in that additive material lines that can be supplied with additive material are present, which empty into the grouting lines in an end segment of said grouting lines.

As a result of the configuration of the tail shield according to the invention with additive material lines that empty into the grouting lines in an end section, an additive material such as a solidification accelerator, for example, can be added immediately before the discharge of the mixture into the ring gap, so that the risk of a blockage of the grouting line, which, in the region of the end of the tail shield, is accessible only with substantial effort, is relatively low. For work breaks, the addition of additive materials is typically stopped and the remaining mixture of filling material and additive material that is still available is discharged from the grouting lines.

In a useful further development of a tail shield according to the invention, it is provided that additive material lines protrude into grouting lines and extend with a parallel segment in the longitudinal direction of the given grouting lines, that the additive material lines exhibit at the end a line head configured with a valve arrangement, and that the line head exhibits as the valve arrangement a valve body with discharge openings and at least one ring collar made of an elastic material and covering the discharge openings. As a result, a reliable, easily metered charging of additive material into the conveying medium is accomplished at relatively low component costs.

In addition, with respect to the removal of a plug-like blockage that may still occur under some circumstances, for example, in the event of a work break of unforeseen length, it is useful for the line head to exhibit a number of recesses applied to the outside in order to achieve good engagement of the line head with the plug for later removal.

In connection with the removal of a plug-like blockage, with further developments of tail shields in accordance with the invention with blocked lines that protrude beyond a certain length into the grouting lines, it is also useful that the additive material lines are made of a material that is resistant to bending, and that sealing units are present in which the additive material lines can be placed movable in the longitudinal direction of the grouting lines. As a result, the additive material lines can be moved in the longitudinal direction of the grouting lines, and support the loosening of a plug, possibly including the pushing out of a detached end piece of a plugged line into the ring gap from the grouting line.

In a useful further development, the sealing units exhibit a seal that surrounds the assigned additive material line, a tensioning nut, and at least one clamping ring that works in cooperation with the tensioning nut and surrounds the associated additive material line, whereby the assigned additive material line can be fixed in place when the tensioning nut is tightened, and at a certain position of the tensioning nut, the assigned additive material line can be moved in the longitudinal direction.

BRIEF DESCRIPTION OF THE DRAWINGS

Additional useful forms and advantages of the invention are the object of the following description of embodiments, with references to the figures in the drawing. The following are shown:

FIG. 1 shows a section view of an embodiment of a tail shield 1 according to the invention from a shield tunneling apparatus that is not shown in further detail in FIG. 1. The tail shield 1 according to the embodiment per FIG. 1 exhibits a tail shield casing 2 in which are integrated a number grouting lines 3 that are straight in an end region. The grouting lines 3 empty in the region of a tail shield end 4 that is configured with a tail shield seal of the single-lip type with conventional use of the shield tunneling apparatus in a ring gap 7 formed between lining segments 5 and the in place soil 6. Filling material such as mortar, for example, can be supplied into the grouting lines 3 in order to fill in the ring gap 7.

DETAILED DESCRIPTION OF THE PREFERRED EMBODIMENTS

Figure 1:
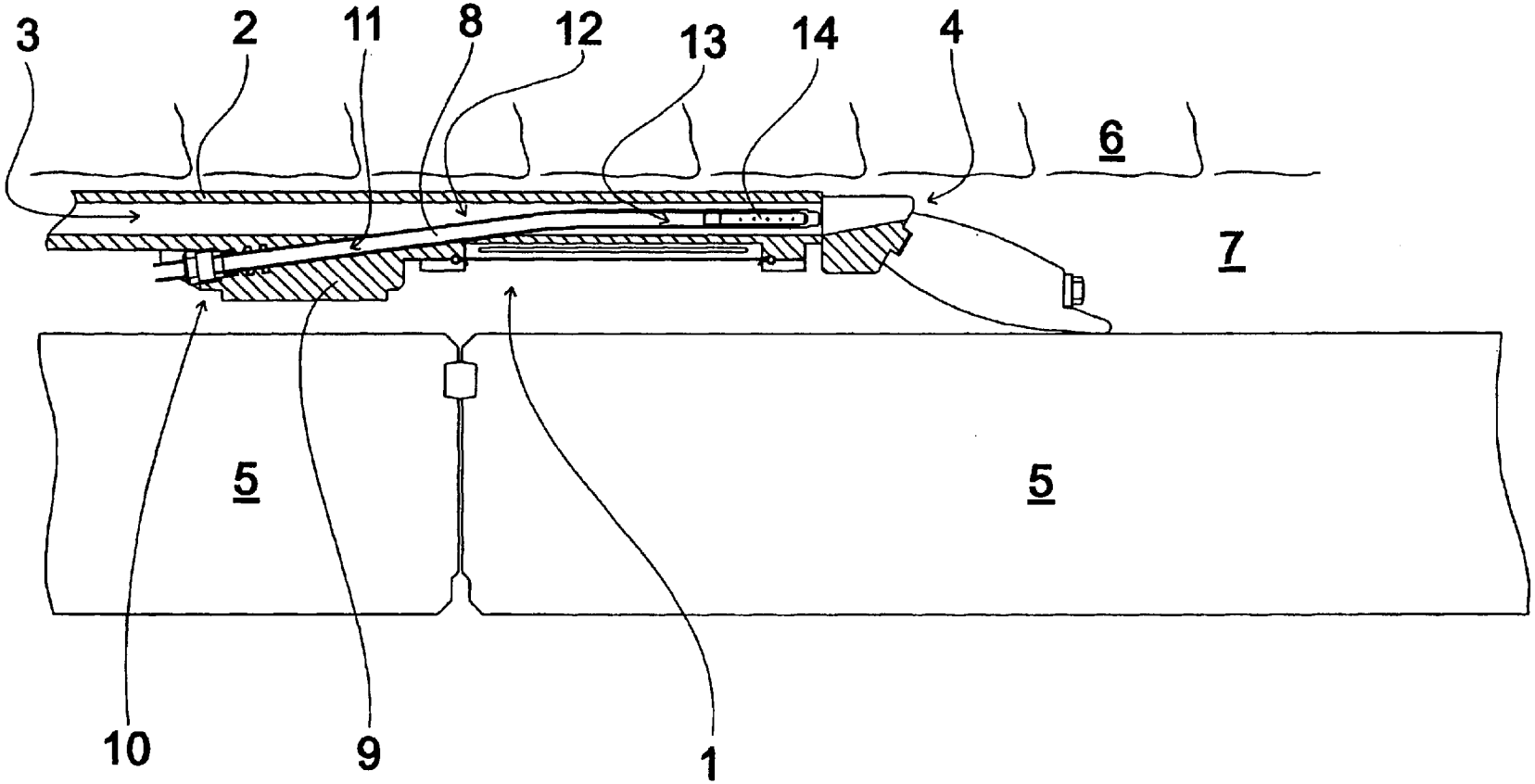
FIG. 1 A section view of an embodiment of a tail shield according to the invention, which exhibits a number of grouting lines that are straight in an end region, and in the emptying region of the grouting lines, additive material lines that end in a ring gap, FIG. 2 A section view of an additional embodiment of a tail shield according to the invention, which exhibits a number of grouting lines that run at an angle before an end segment, and, in the emptying region of the grouting lines, additive material lines that end in a ring gap, FIG. 3 A section view of an additional embodiment of a tail shield according to the invention, having an additive material line that is arranged offset versus the arrangements according to FIG. 1 and FIG. 2, FIG. 4 In a section view of the embodiment according to FIG. 3, an ejection of an end piece of an additive material line, FIG. 5 A section view of an exemplary configuration of a sealing unit for the sealed fixing in place of an additive material line, as well as an exemplary configuration of a line head of an additive material line, and FIG. 6 A section view of a further development of a line head of an additive material line according to FIG. 5.

In the case of the embodiment according to FIG. 1, inserted into each grouting line 3 is an additive material line 8, which is made of a material that is resistant to bending to a certain extent, but is still bendable, and which can be supplied with an additive material that is to be supplied to the filler material, such as, in particular, a solidification accelerator. Each additive material line 8 extends through an insertion adapter 9, which is designed as one piece with the tail shield casing 2 in the embodiment shown, and which accommodates the sealing unit 10 that surrounds the particular additive material line 8. With the sealing units 10, the additive material lines 8 can be fixed in place in a specific position. Each additive material line 8, which is aligned with an insertion segment 11 at an angle to the particular grouting line 3, is placed in an end segment 12, which extends from the insertion adapter 9 to the tail shield end 4, of the associated grouting line 3 after an offset with a parallel segment 13, which is produced by turning and suitable alignment, essentially parallel and approximately centrally within said end segment 12 of the given grouting line 3.

At the end facing the tail shield end 4, each additive material line 8 is equipped with a line head 14, which is equipped with a valve arrangement and through which the additive material can be introduced into the particular grouting line 3. With the arrangement of the line head 14 in the immediate vicinity of the tail shield end 4, during operation the additive material thus does not mix with the filler material until immediately before the filler material enters the ring gap 7, so that the effects desired as a result of the additive material, such as, in particular, an accelerated hardening of the mortar, occur only inside the ring gap 7, and not already inside the grouting lines 3 further from the tail shield end 4, with the risk of an unwanted and extremely difficult to clear hardening inside the grouting lines 3.

During work breaks, the addition of the additive material is typically stopped and the remaining mixture of filler material and additive material that is still on hand is conveyed out of the grouting lines 3 and into the ring gap 7.

Figure 2:
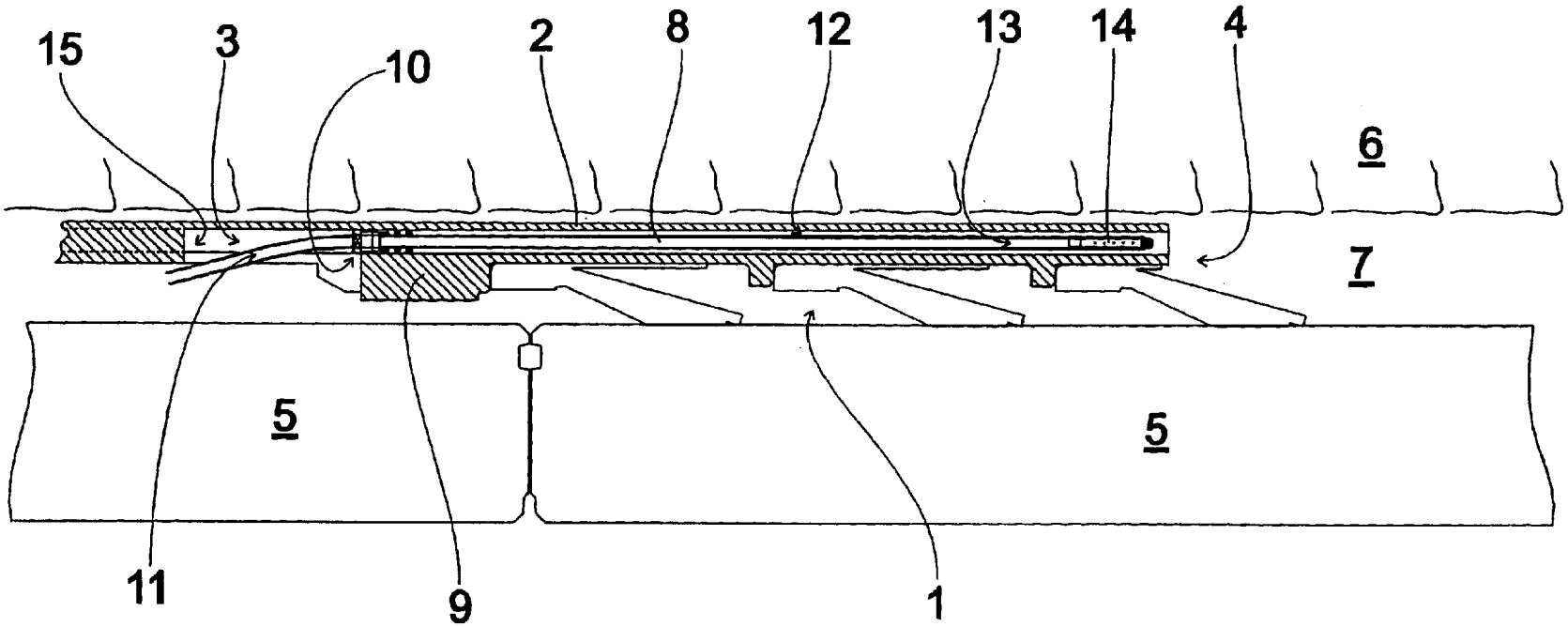

FIG. 2 shows a section view of an additional embodiment of a tail shield 1 according to the invention, which exhibits a number of grouting lines 3 that run at an angle ahead of, in the direction of flow of the filler material, an end segment 12 and empty into the ring gap 7 that was explained by means of the embodiment per FIG. 1. In accordance with the embodiment explained by means of FIG. 1, the additive material lines 8 end near the tail shield end 4, which in the embodiment according to FIG. 2, is configured with a brush-type tail shield seal. In this embodiment, the additive material lines 8 extend between an insertion adapter 9 with a parallel segment 13 that is placed after, in the direction of flow of the filler material that can be supplied into the grouting lines 3, a last bend 15, and the tail shield end 4, essentially parallel and approximately centrally within the given grouting line 3, so that additive material coming from the line head 14, which, in the representation according to FIG. 2, is placed in the immediate vicinity of the tail shield end 4, can be mixed relatively homogeneously with the filler material that is flowing in grouting lines 3.

Figure 3:
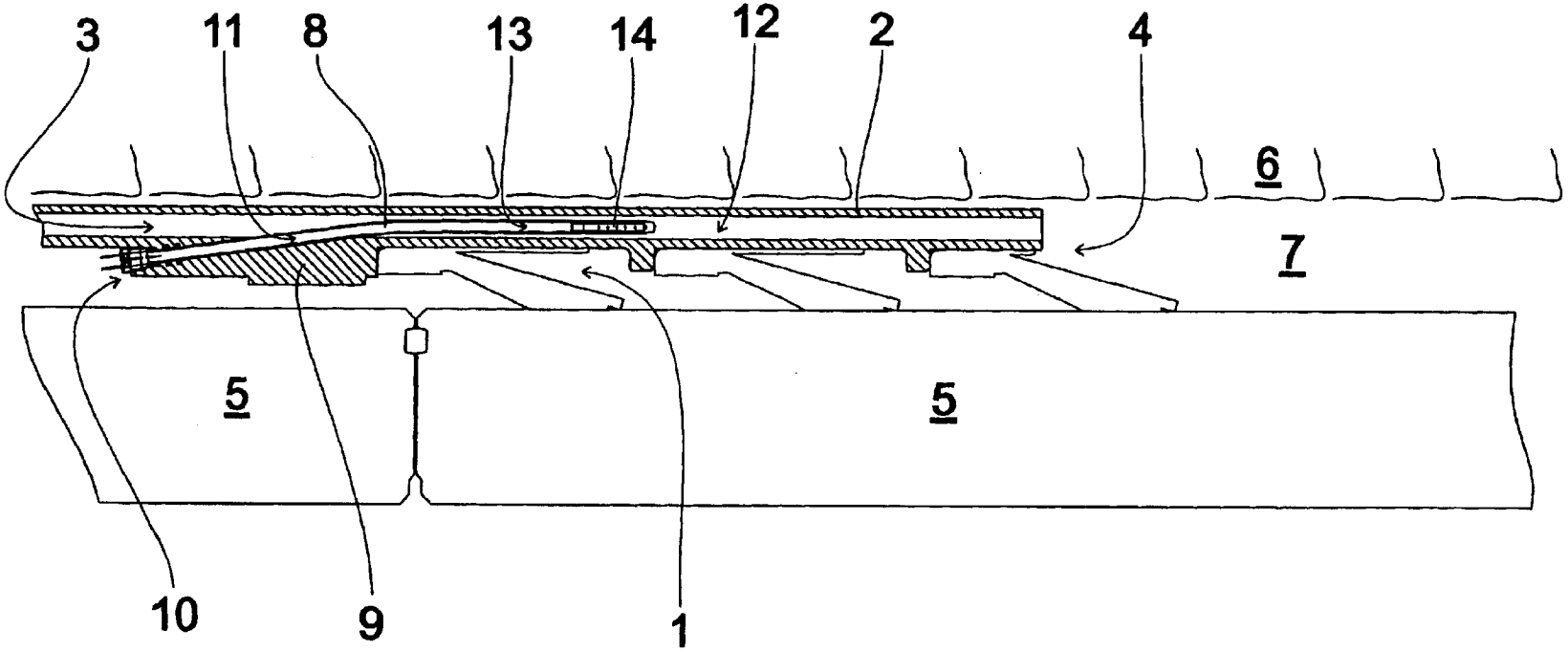

FIG. 3 shows a section view of an additional embodiment of a tail shield 1 according to the invention, having an additive material line 8 that is arranged offset versus the arrangements according to FIG. 1 and FIG. 2. In the arrangement according to FIG. 3, the line head 14 is placed in the end segment 12 of the grouting line 3 at a certain distance from the tail shield end 4, so that the additive material coming out of the line head 14 in the flow of filler material mixes with the filler material while still inside the remaining segment of the end segment 12 up to the tail shield end 4, and the effects brought about by the additive material are already occurring before entry of the mixture into the ring gap 7. As a result of the specific arrangement of the line head 14, a relatively exact adjustment of the properties of the mixture of filler material and the admixed additive material can thus be achieved upon discharge from the tail shield end 4.

Figure 4:
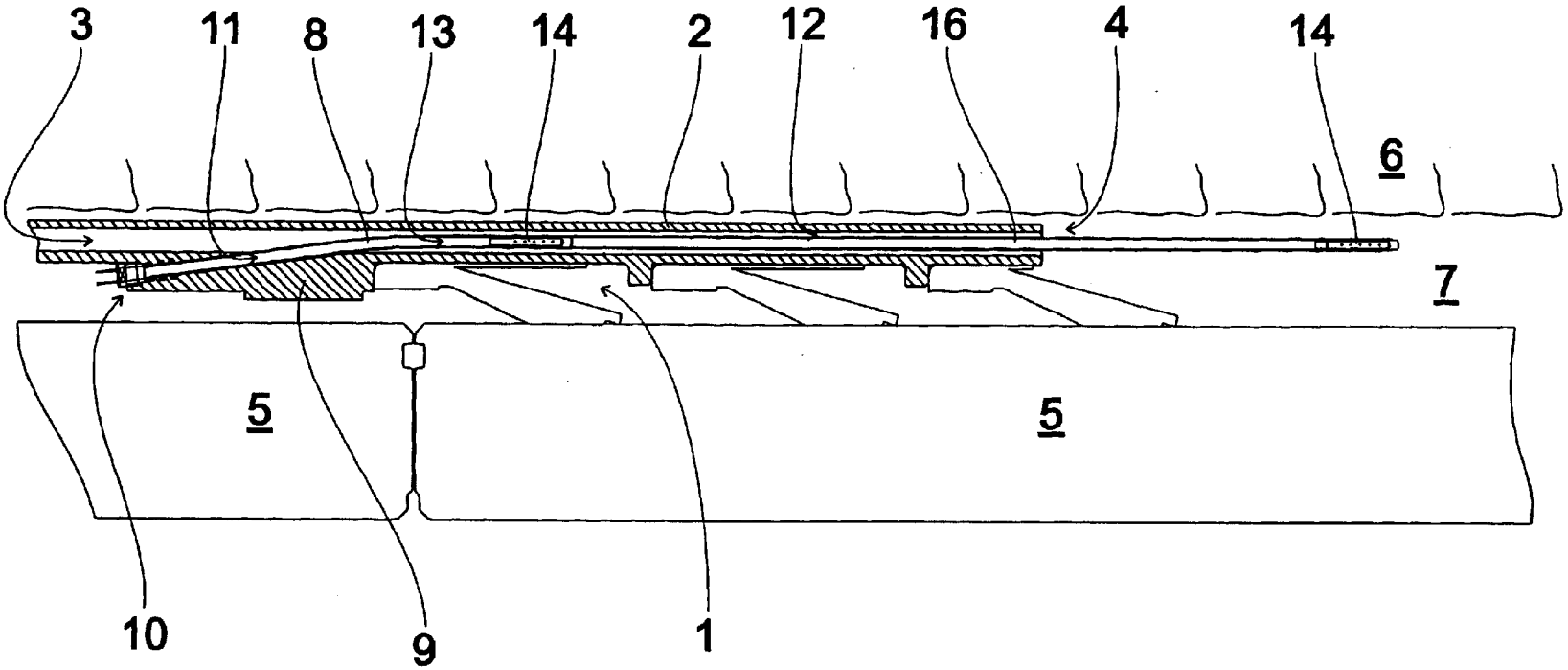

FIG. 4. shows, in a section view of the embodiment according to FIG. 3, an ejection of an end piece 16 of an additive material line 8. In preceding steps that are not shown, the end piece 16 was separated ahead of, in the direction of flow of the additive material, the sealing unit 10, and was brought into the position shown in FIG. 4 by pushing forward the additive material line 8, which has again been fitted with a line head 14, in the direction of the tail shield end 4 with the sealing unit 10 adequately loosened. Upon further pushing forward of the additive material line 8 in the direction of the tail shield end 4, the end piece 16 is finally ejected into the ring gap 7. In addition, blockages of the grouting lines 3 that occur as a result of plug formation can be eliminated in this way, even in the region of the tail shield end 4, in that the end piece 16 that is in engagement with a plug is ejected, taking the plug with it.

Figure 5:
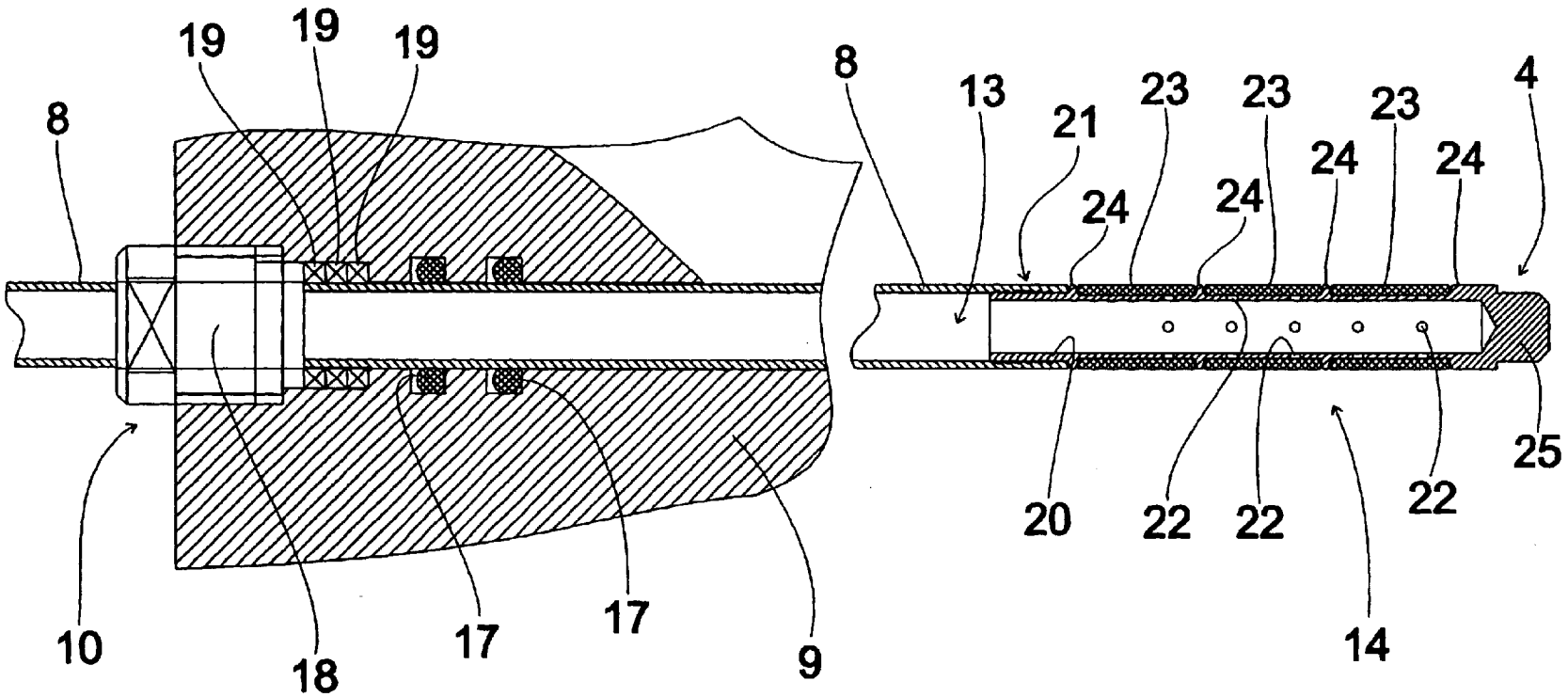

FIG. 5 shows a section view of an exemplary configuration of a sealing unit 10 for the sealed fixing in place of an additive material line 8, as well as an exemplary configuration of a line head 14 of an additive material line 8.

The sealing unit 10 in accordance with the configuration of FIG. 5 has as seals round cord seals 17, which are placed in associated recesses in the insertion adapter 9 and which surround the additive material line 8 in sealing fashion. In addition, the sealing unit 10 is equipped with a tensioning nut 18 and clamping rings 19 that work in cooperation with the tensioning nut 18. The tensioning nut 18 can be screwed onto a thread that is formed on the insertion adapter 9, whereby when the tensioning nut 18 is tightened, the clamping rings 19 are pressed against the additive material line 8, fixing same in place. When the tensioning nut 18 is loosened again, the pressing force of the clamping rings 19 is reduced, so that at a certain position of the tensioning nut 18, the additive material line 8 can be moved in the longitudinal direction.

The line head 14 in accordance with the configuration of FIG. 5 exhibits a cylindrical valve body 20, which is mounted via a locking connection 21 on the end of the parallel segment 13 of the additive material line 8 that faces the tail shield end 4. The valve body 20 has a valve arrangement with a number of discharge openings 22 made in the wall, which are covered by ring collars 23 made of an elastic material. The fit of each ring collar 23 covering the discharge openings 22 is assured by ring shoulders 24 that protrude circumferentially beyond the outside of the valve body 20. Finally, the line head 14 has on the end a terminating piece 25 by means of which the end of the valve body 20 pointing away from the parallel segment 13 is closed. In the configuration of the line head 14 per FIG. 5, at a certain overpressure inside the additive material line 8, additive material begins to come out through the discharge openings 22, while the ring collars 23 prevent the penetration of filler material into the additive material line 8.

Figure 6:
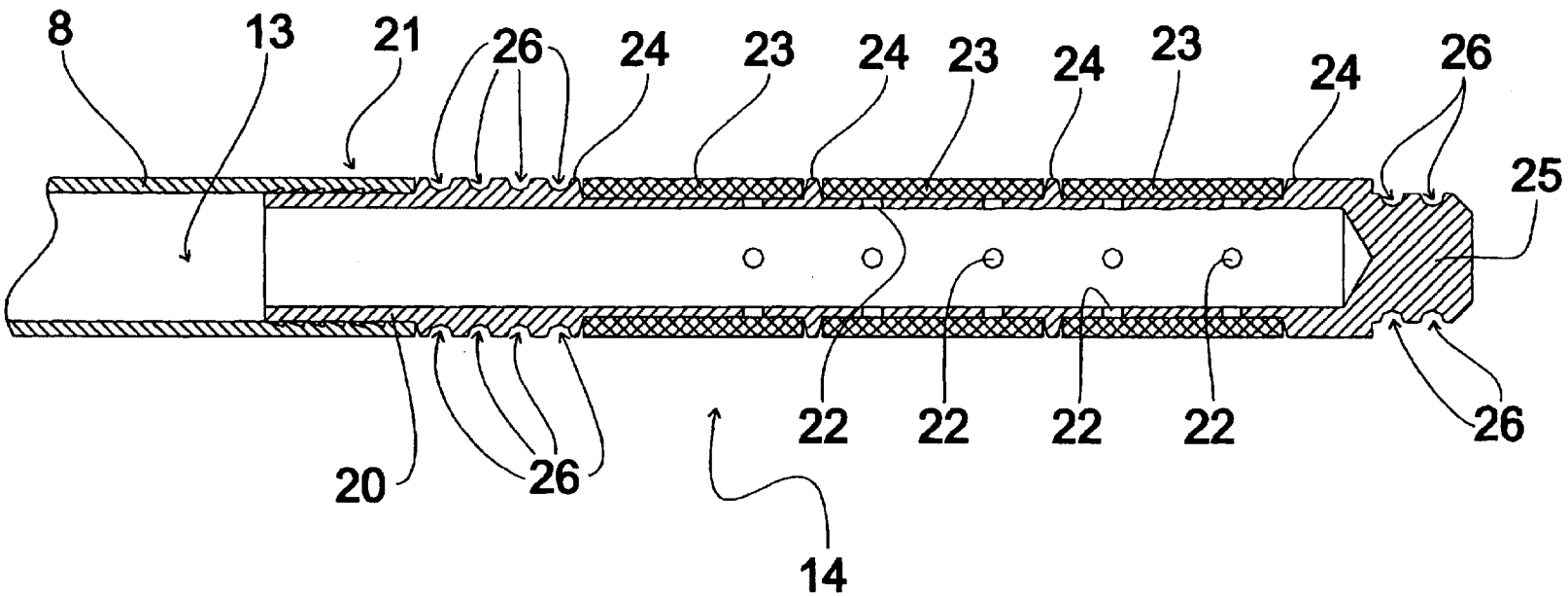

FIG. 6 shows a section view of a further development of a line head 14 of an additive material line 8 according to FIG. 5. In the further development per FIG. 6, a number of, for example, ring-shaped recesses 26 are made in the valve body 20 and in the terminating piece 25, which, in the event of the hardening of the mixture of filler material and additive material in the grouting line 3, are in engagement with the plug that has formed in the grouting line 3. As a result, a greater transmission of force to the plug is achieved when the additive material line 8, or an end piece 16 of same per FIG. 4, is moved, and the freeing of the grouting line 3 is facilitated.

What is claimed is:

1. A tail shield for a shield tunneling apparatus, comprising a plurality of grouting lines that are open to a tail shield end and that can be supplied with filling material for grouting a ring gap with the filling material; a plurality of additive material lines made of a material that is resistant to bending that can be supplied with additive material, wherein the additive material lines empty into the grouting lines in an end segment of said grouting lines and the additive material lines protrude into the grouting lines and extend with a parallel segment in the longitudinal direction of the grouting lines; and sealing units in which the additive material lines can be placed movable in the longitudinal direction of the grouting lines.

2. A tail shield according to claim 1, wherein the additive material lines include a line head configured with a valve arrangement disposed at a distal end of the additive material line.

3. A tail shield according to claim 2, wherein the valve arrangement comprises a valve body having discharge openings and at least one ring collar made of an elastic material and covering the discharge openings.

4. A tail shield according to claim 2, wherein the line head includes a number of recesses applied to the outside.

5. A tail shield according to claim 1, wherein the sealing units each include at least one seal that surrounds the assigned additive material line, a tensioning nut, and at least one clamping ring that works in cooperation with the tensioning nut and surrounds the associated additive material line, whereby the assigned additive material line can be fixed in place when the tensioning nut is tightened, and at a certain position of the tensioning nut, the assigned additive material line can be moved in the longitudinal direction.

* * * * *